US008918036B2

(12) United States Patent
Kitagawa

(10) Patent No.: US 8,918,036 B2
(45) Date of Patent: Dec. 23, 2014

(54) DEVELOPING DEVICE AND IMAGE FORMING APPARATUS USING THE SAME

(75) Inventor: Tomo Kitagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 195 days.

(21) Appl. No.: 13/589,730

(22) Filed: Aug. 20, 2012

(65) Prior Publication Data

US 2013/0108330 A1 May 2, 2013

(30) Foreign Application Priority Data

Oct. 27, 2011 (JP) ..... 2011-235587

(51) Int. Cl.
*G03G 15/08* (2006.01)
*G03G 15/01* (2006.01)

(52) U.S. Cl.
CPC ..... *G03G 15/0194* (2013.01); *G03G 15/0812* (2013.01); *G03G 2215/0141* (2013.01)
USPC ..... 399/284

(58) Field of Classification Search
CPC ..... G03G 15/0812; G03G 21/0029
USPC ..... 399/274, 284
See application file for complete search history.

(56) References Cited

U.S. PATENT DOCUMENTS 7,840,168 B2 11/2010 Nishida et al.
8,019,258 B2 9/2011 Nishida et al.
2007/0177906 A1* 8/2007 Yamanaka et al. ..... 399/279
2007/0297833 A1 12/2007 Nishida et al.
2007/0297834 A1 12/2007 Nishida et al.
2011/0026978 A1 2/2011 Nishida et al.

FOREIGN PATENT DOCUMENTS

JP 04-086854 3/1992
JP 2001-83799 A 3/2001
JP 2005-115082 4/2005
JP 2008-003393 1/2008
JP 2009-86554 4/2009
JP 2009-288817 A 12/2009

OTHER PUBLICATIONS

JP 2005-115082 English translation, Kawahito, Apr. 28, 2005.*

* cited by examiner

*Primary Examiner* — David Gray
*Assistant Examiner* — Thomas Giampaolo, II
(74) *Attorney, Agent, or Firm* — Birch, Stewart, Kolasch & Birch, LLP

(57) ABSTRACT

A developing device includes a developing roller supplying toner to the photoreceptor and a toner layer regulatory member regulating the layer thickness of toner supported on the surface of the developing roller. The toner layer regulatory member has flexible sheets abutting the developing roller and a holder holding the flexible sheets. The multiple flexible sheets are formed along the axial direction of the developing roller and arranged side by side across the circumferential direction of the developing roller. Each flexible sheet has a projected end as a free end which spreads across the length of the developing roller and projects toward the developing roller while the other end side is held as a supported end by the holder. The sheet holder has depressions for holding the flexible sheets in a movable manner.

4 Claims, 7 Drawing Sheets

DEVELOPING DEVICE AND IMAGE FORMING APPARATUS USING THE SAME

This Nonprovisional application claims priority under 35 U.S.C. §119 (a) on Patent Application No. 2011-235587 filed in Japan on 27 Oct. 2011, the entire contents of which are hereby incorporated by reference.

BACKGROUND OF THE INVENTION (1) Field of the Invention

The present invention relates to a developing device for use in an image forming apparatus based on electrophotography and an image forming apparatus using this developing device, in particular relating to a developing device using a mono-component developer for developing an electrostatic latent image formed on an electrostatic latent image bearer with toner as well as to an image forming apparatus using this developing device.

(2) Description of the Prior Art

As a conventional developing device of an image forming apparatus based on electrophotography, there is a configuration which adopts a non-contact development technique using non-magnetic toner with a developing roller made of a metal sleeve as a developer bearer. In this case, the developing device includes a developer quantity regulatory member for regulating the amount of the developer in order to form a thin layer of mono-component toner on the developer bearer. Known as the developer quantity regulatory member is a blade shaped thin plate-like elastic member, which is cantilevered along one side, and whose flat part on the opposite side is abutted against the developing roller.

When the developer quantity regulatory member is made small, the distance from the supported end of the thin plate to the point of abutment on the developing roller, or the free length becomes short. As a result, the spring constant that dominates the pressure of abutment becomes greater, so that the pressure of abutment will greatly change even if the set position of the developer quantity regulatory member is slightly displaced. This requires high precision in assembly in order to ensure a stable pressure of abutment.

Further, when a conventional developer quantity regulator member is used, the maximum value of pressure of abutment (the pressure of abutment in the center of the nip portion in the pressure distribution of the abutment nip portion) tends to vary along the longitudinal direction of the developer quantity regulatory member (the direction in which the axis of the developing roller extends). Accordingly, variation of the degree of toner degradation arises across the roller length after aging (long use of the developing device). As a result, there occurs the problem that density unevenness appears after aging in the solid image across the length of the roller.

Further, in the case of the above developer quantity regulatory member, in assembly of the developing device, as the pressing action of the blade against the developing roller before and after assembly, or so called "developing roller push-in quantity" increases, the maximum pressure of abutment increases proportionally to the developing roller push-in quantity.

For this reason, it is expected that the maximum pressure of abutment also varies due to variation of the developing roller push-in quantity at the time of assembly. As a result, in order to stably set and keep the desired maximum pressure of abutment with little variation, high assembly precision is needed.

Further, when the set position between the developer quantity regulatory member and the developing roller varies due to production tolerance, radial run-out of the developing roller and other factors, along the length of the developing roller, or when the developer roller push-in quantity to the developer quantity regulatory member varies along the length direction of the roller, variation in the maximum pressure of abutment between the developer quantity regulatory member and the developer roller occurs along the length direction. From this, variation in the degree of toner degradation after aging arises along the longitudinal direction. As a result, density unevenness takes place in the solid image after aging over the length of the developing roller.

On the other hand, recently, as a measure for reducing power consumption of an electrophotographic apparatus, it is demanded to reduce power consumption in the fixing process. In the fixing process, in order to achieve lower consumption of power, it is effective to lower the quantity of heat required for fusing toner, or lower the melting point of the toner.

However, a toner having a low melting point is favorable to low-temperature fixing, whereas the strength against toner stress lowers. Accordingly, in the conventional mono-component developing system, the toner is liable to be crushed and fused due to pressure receiving from the developer quantity regulatory member. Use of toner having such a low melting point further makes conspicuous the variation in the degree of toner degradation depending on the aforementioned variation of the maximum pressure of abutment.

In order to deal with this problem, for example there is a proposal of a developing device which comprises: a flexible sheet-like developer quantity regulator member having a pressing part abutting and pressing a developer bearer; and a holding part for holding the developer quantity regulatory member so that the developer quantity regulatory member takes a curved form projected toward the developer bearer in a state where the developer quantity regulatory member is not in abutment with the developer bearer (see Patent Document 1).

Patent Document 1

Japanese Patent Application Laid-open 2009-288817

However, in the developing device of Patent Document 1, the flexible sheet-like developer quantity regulatory member deforms at the time of assembling the developer bearer, and the abutment of the developer quantity regulatory member on the developer bearer becomes unstable as the developer bearer rotates, hence the pressure of abutment is not stable so that it is impossible to perform uniform regulation of the developer quantity. Further, when the push-in quantity is large and hence the developer bearer is put under a high pressure of abutment, the width of abutment becomes greater so that large stress is applied to the toner.

SUMMARY OF THE INVENTION

The present invention has been devised in view of the above problem, it is therefore an object of the present invention to provide a developing device that can suppress deformation of the abutment of a developer quality regulatory member so as to realize stable pressure of abutment and reduce stress on toner, as well as providing an image forming apparatus using the same device.

The developing device according to the present invention to solve the above problem and image forming apparatus using the same device are configured as follows:—

According to the first aspect of the present invention, a developing device for use in an image forming apparatus for visualizing an electrostatic latent image on an electrostatic latent image bearer with toner, includes: a developing roller supplying toner to the electrostatic latent image bearer in the image forming apparatus; and, a toner layer regulatory member put in pressing contact with the developing roller to regulate the layer thickness of toner supported on the surface of the developing roller, and is characterized in that the toner layer regulatory member includes a plurality of flexible sheet-like elastic parts abutting the developing roller and a holding part holding the elastic parts, the plural elastic parts are formed along the axial direction of the developing roller and arranged side by side across the circumferential direction of the developing roller, each elastic part has a projected end side as a free end which spreads in the axial direction of the developing roller and projects toward the developing roller while the other end side is held as a supported end by the holding part, and the holding part has a depression which holds the other end side of the elastic part in such a manner that the free end side of the elastic part can move.

According to the second aspect of the present invention, it is preferable that the elastic part is held in the depression in a curved condition.

According to the third aspect of the present invention, it is preferable that the holding part includes a plurality of depressions corresponding to the plural elastic parts, the plural elastic parts are specified such that the thickness of the sheet-like part of the elastic part located on the upstream side with respect to the rotational direction of the developing roller is greater than the thickness of the elastic part located on the downstream side with respect to the rotational direction of the developing roller, and the width in the circumferential direction of the developing roller of the plural depressions is made narrower in the depression located on the upstream side with respect to the rotational direction of the developing roller than in the depression on the downstream side with respect to the rotational direction of the developing roller.

According to the fourth aspect of the present invention, it is preferable that the depression has a curved surface or a slope as a holding structure for holding the supported ends of the elastic part, and the supported ends are movable at both ends or at one end relative to the depression.

According to the fifth aspect of the present invention, an image forming apparatus for performing image forming based on electrophotography, includes: an electrostatic latent image bearer on which an electrostatic latent image is formed; and a developing device for visualizing an electrostatic latent image on the electrostatic latent image bearer with toner, and is characterized in that the developing device employs a developing device having any one of the above first to fourth features.

According to the above first aspect of the present invention, it is possible to suppress deformation of the abutment between the elastic part and the developing roller while assuring a stable pressure of abutment. Further, since plural elastic parts are provided, by changing the thickness (width) and/or hardness of the sheet of the elastic part, it is possible to perform toner layer regulation with enhanced pressure of abutment and a reduced width of abutment of the elastic parts and achieve electrification with a low pressure of abutment and a large width of abutment. Accordingly, it is possible to alleviate stress on the toner.

According to the above second aspect of the present invention, it is possible to change the hardness and pressure of abutment and width of abutment of the elastic part, depending on the thickness of the sheet-like part.

According to the third aspect of the present invention, since the width of abutment of the elastic part on the upstream side with respect to the rotational direction of the developing roller can be made small to increase the pressure of abutment, it is possible to regulate the toner layer with a reduced stress on the toner. Further, since the width of abutment of the elastic part on the downstream side with respect to the rotational direction of the developing roller can be made large to decrease the pressure of abutment, it is possible to electrify the toner with a reduced stress on the toner.

According to the fourth aspect of the present invention, since the elastic part is moved by a small change in pressure of abutment between the elastic part and the developing roller due to change of the push-in quantity, it is possible to stabilize the pressure of abutment. Further, when the depression is formed with a slope, it is possible to easily control the pressure of abutment stably by changing the angle of inclination of the slope.

According to the fifth aspect of the present invention, it is possible to make the toner layer regulatory member apply a stable pressure of abutment and hence alleviate stress on the toner.

BRIEF DESCRIPTION CF THE DRAWINGS

Figure 3:
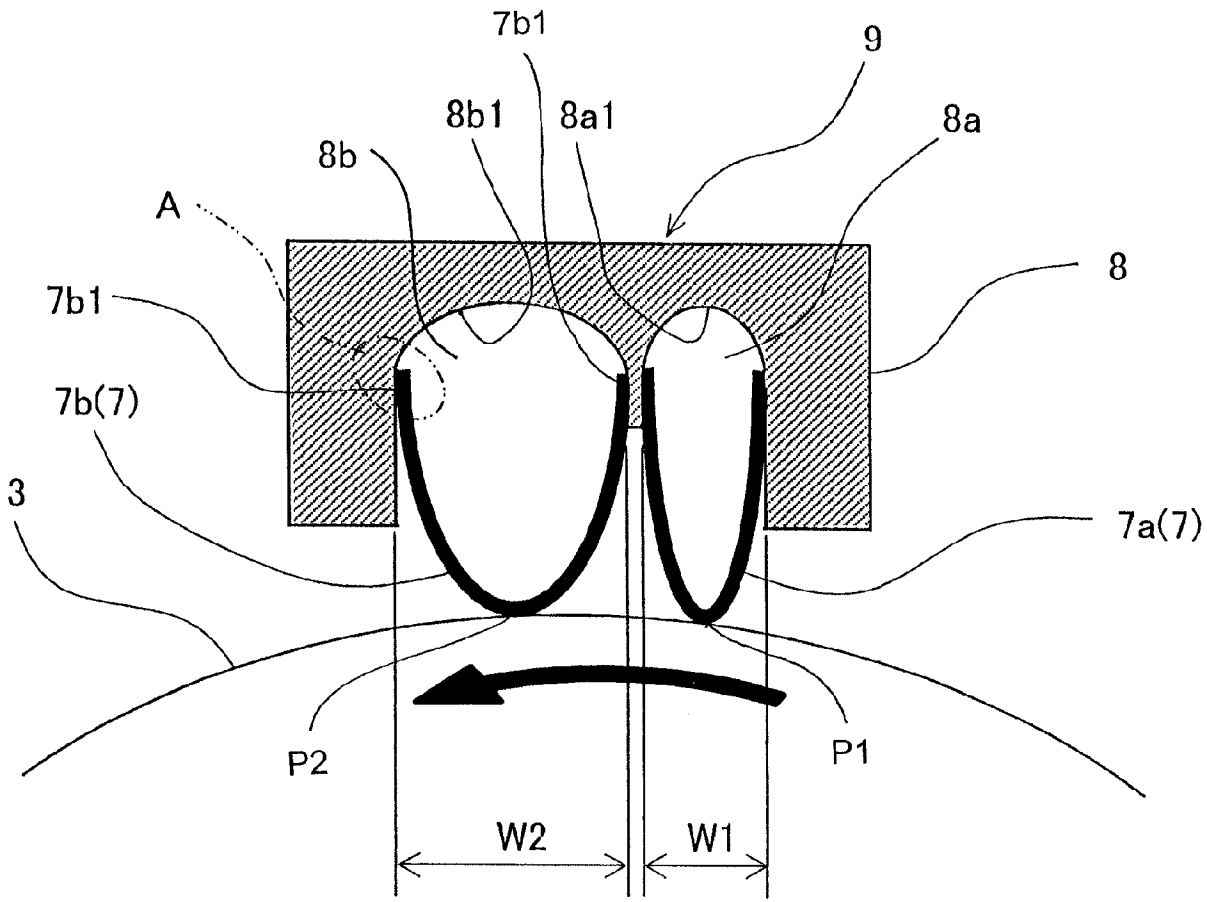
FIG. 3 is an illustrative view showing a configuration of a toner layer regulatory member of the present embodiment.
Figure 4A:
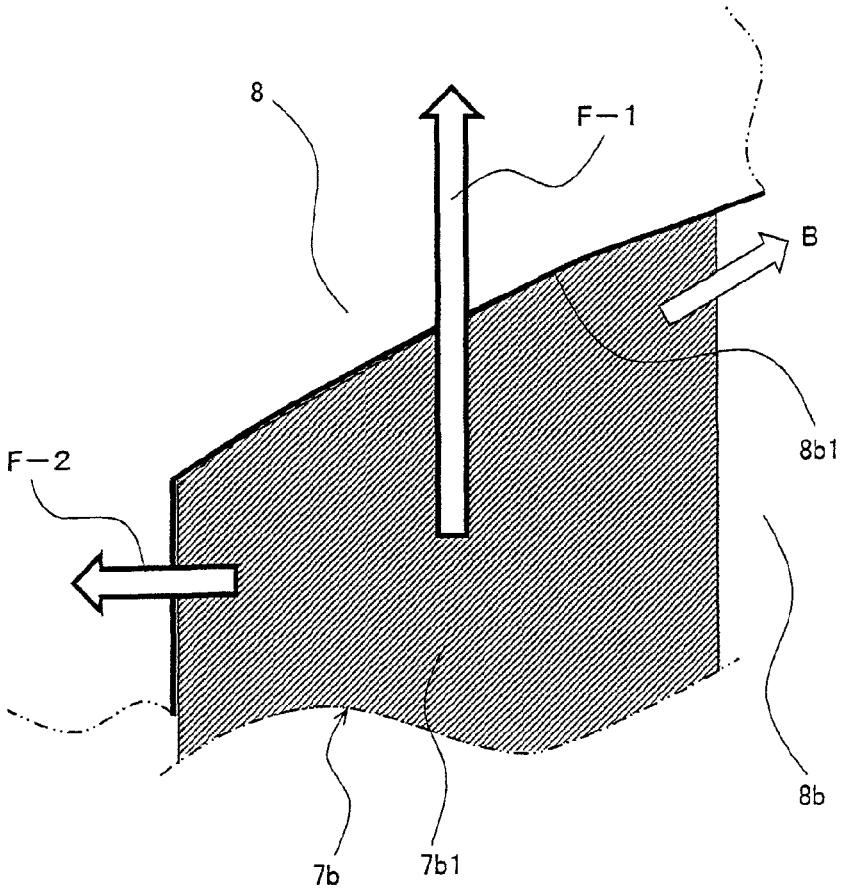
Figure 4B:
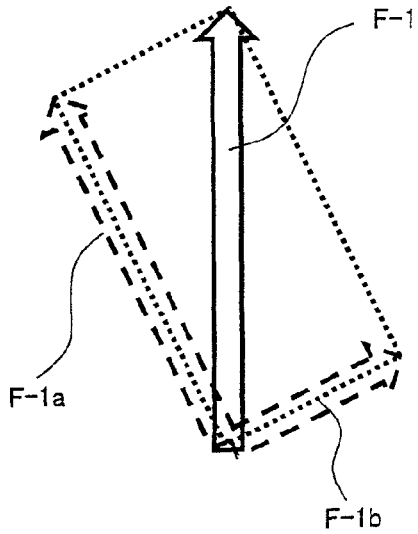
Figure 4C:
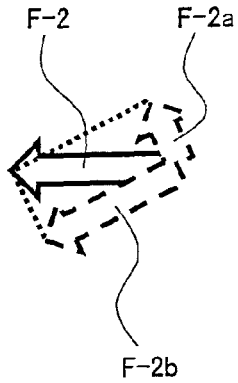
Figure 5:
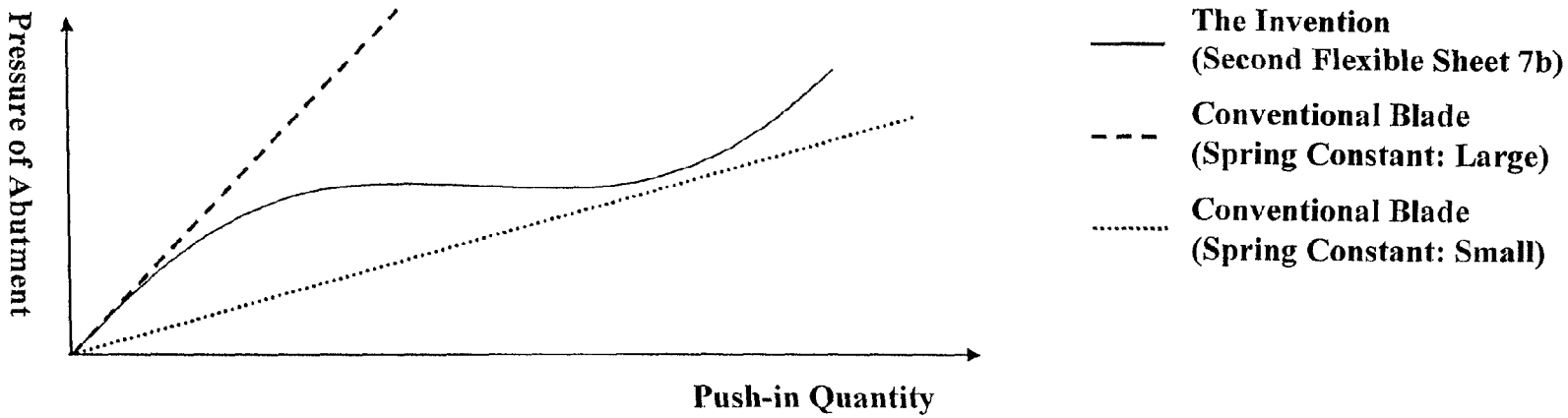
Figure 6:
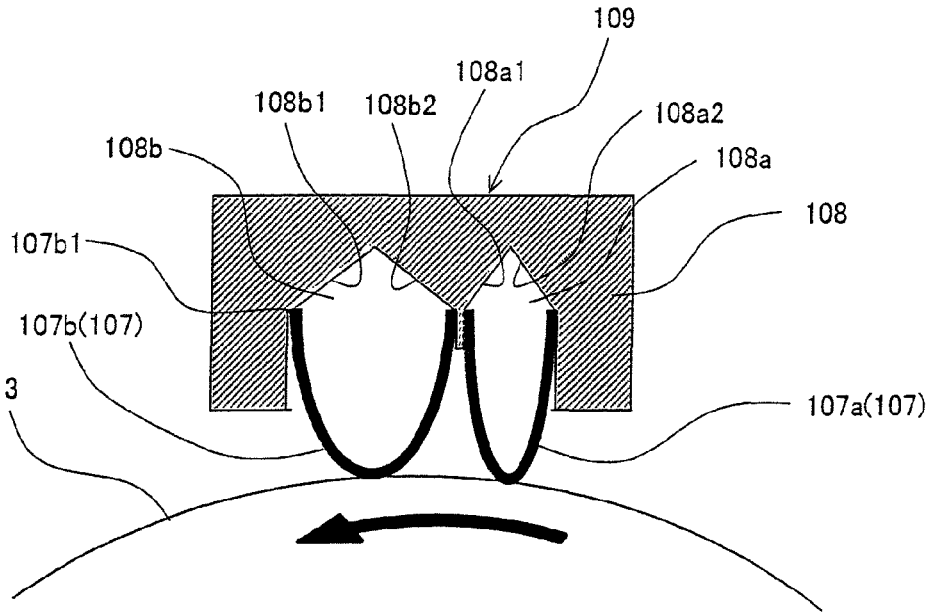
Figure 7:
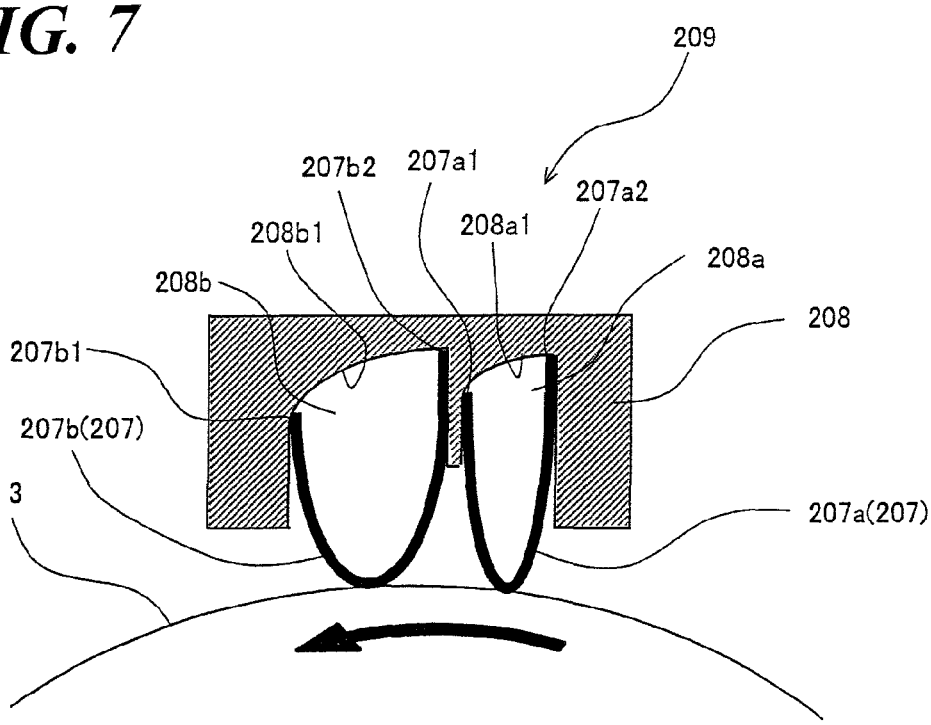
Figure 8:
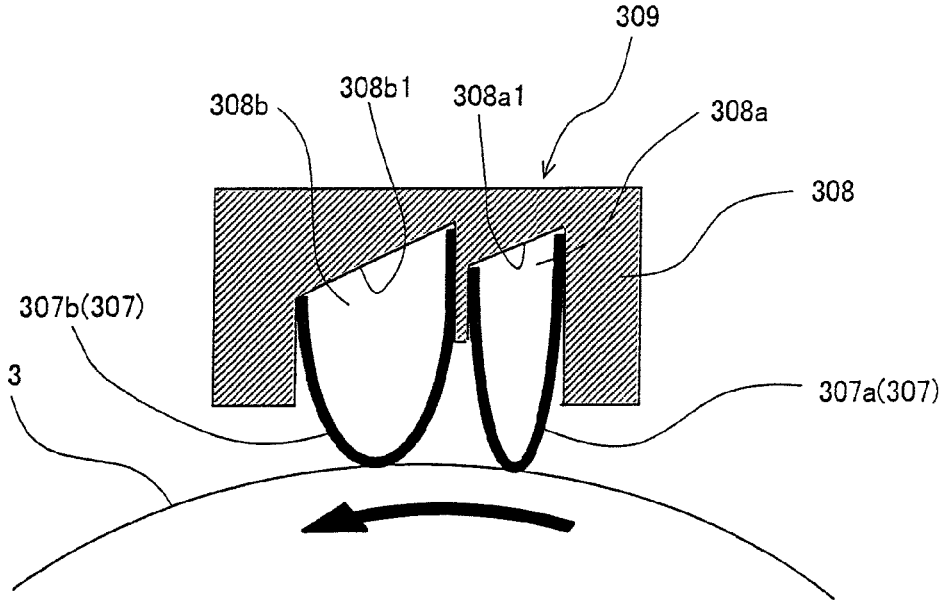
Figure 9:
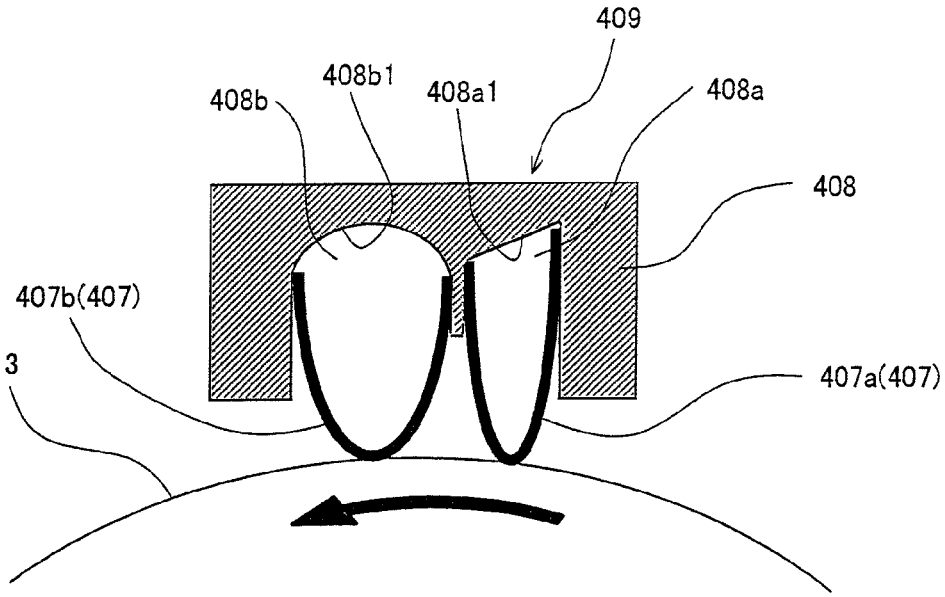

FIG. 4A detailedly shows a part designated at A in FIG. 3 and is a detailed illustrative view showing a held condition of a flexible sheet around a depression of a sheet holder as a part of the toner layer regulatory member;

FIG. 4B is an illustrative view showing a force (force components) applied on a slope (curved surface) of a depression of the sheet holder;

FIG. 4C is an illustrative view showing a force (force components) applied on a side surface of a depression of the sheet holder;

FIG. 5 is a graph showing the relationship between the push-in quantity and the pressure of abutment to compare the flexible sheet of the present embodiment with the conventional blade;

FIG. 6 is an illustrative view showing a variational example 1 of a toner layer regulatory member of the present embodiment;

FIG. 7 is an illustrative view showing a variational example 2 of a toner layer regulatory member of the present embodiment;

FIG. 8 is an illustrative view showing a variational example 3 of a toner layer regulatory member of the present embodiment; and, FIG. 9 is an illustrative view showing a variational example 4 of a toner layer regulatory member of the present embodiment.

DESCRIPTION OF THE PREFERRED EMBODIMENTS

The embodiment of realizing a developing device of the present invention and an image forming apparatus equipped with the developing device will be described with reference to the drawings.

Figure 1:
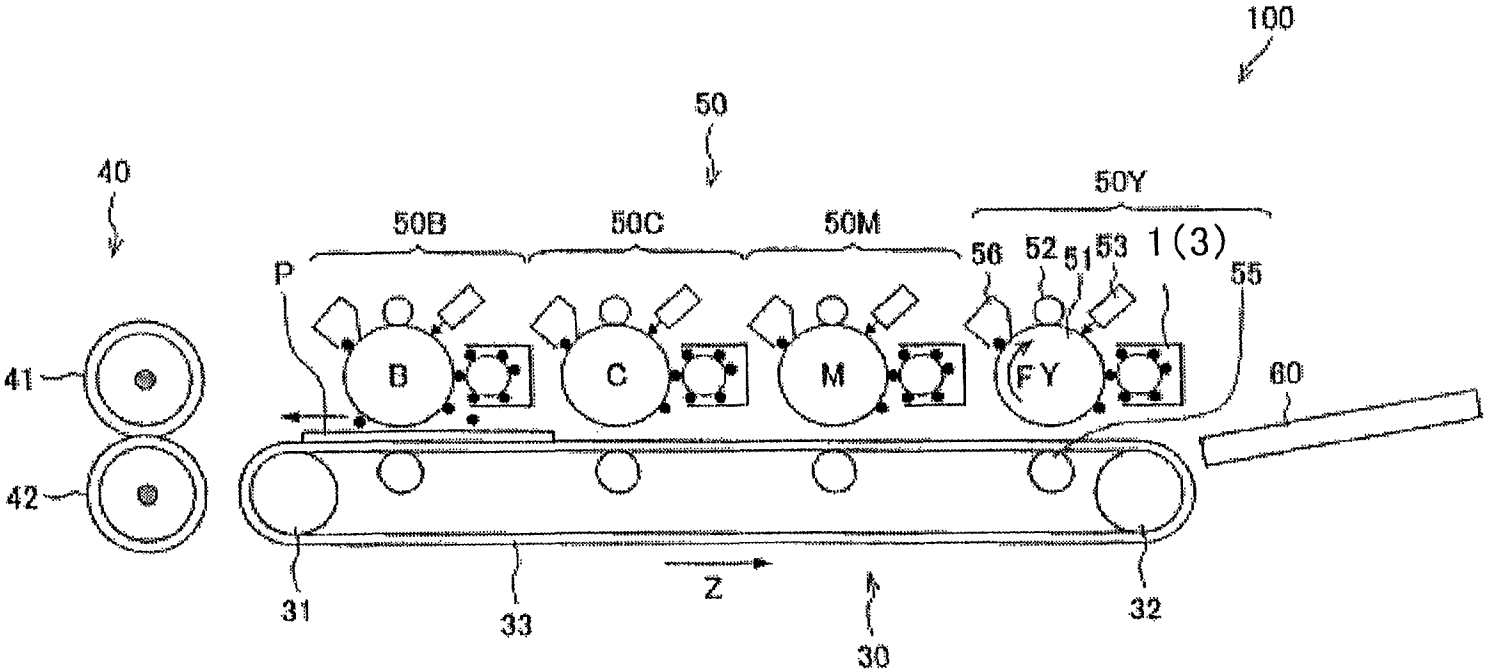
FIG. 1 is an illustrative view showing one example of a partial configuration of an image forming apparatus equipped with a developing device according to the embodiment of the present invention.

FIG. 1 is an illustrative view showing one example of an embodiment of the present invention, a partial configuration of an image forming apparatus equipped with a developing device according to the embodiment of the present invention.

In the description hereinbelow to describe the developing device of the present invention, it goes without saying that typically used technologies of image forming apparatus can be applied for the other components of the image forming apparatus. Components having substantially the same functions are allotted with the same reference numerals without making a repeated description.

As shown in FIG. 1, an image forming apparatus 100 according to the present embodiment includes photoreceptors (electrostatic latent image bearers) 51 forming electrostatic latent images and developing devices 1 to form image forming based on electrophotography.

Developing device 1 includes a developing roller 3 supplying toner to photoreceptor 51; and a toner layer regulatory member 9 (see FIG. 2) which is put in pressing contact with developing roller 3 to limit the layer thickness of the toner supplied on the developing roller 3 surface.

Developing device 1 with a bias voltage applied to developing roller 3 visualizes the electrostatic latent image on photoreceptor 51 with toner.

Now, the overall configuration of image forming apparatus 100 equipped with developing device 1 will be described.

Image forming apparatus 100 is a tandem type color image forming apparatus including four photoreceptors 51 serving as electrostatic latent image bearers for yellow image (Y), magenta image (M), cyan image (C) and black image (B), to thereby form full color images.

Image forming apparatus 100 has a printer function of forming a color or monochrome image on a sheet of paper P as a printing medium (recording medium), in accordance with image data transmitted from various kinds of terminals such as PCs (Personal Computer) and the like connected via networks, or image data scanned by a document reader such as a scanner.

As shown in FIG. 1, image forming apparatus 100 includes: an image forming station unit 50 (50Y, 50M, 50C and 50B) having a function of forming a toner image on paper P; a fixing unit 40 having a function of fixing the toner image formed on paper P by the image forming station unit 50; and a conveyor system 30 having a function of conveying paper P from a paper feed tray 60 having paper P stacked thereon toward fixing unit 40 by way of image forming station unit 50.

Image forming station unit 50 includes four image forming stations 50Y, 50M, 50C and 50B for yellow, magenta, cyan and black images. Specifically, between paper feed tray 60 and fixing unit 40, yellow image forming station 50Y, magenta image forming station 50M, cyan image forming station 50C and black image forming station 50B are laid out in this order from the paper feed tray 60 side.

These image forming stations 50Y, 50M, 50C and 50B for different colors have substantially the same configurations other the toner type, and form yellow, magenta, cyan and black toner images based on image data corresponding to respective colors, and transfer the images onto paper P as a final recording medium.

Though the image forming station unit 50 of the present embodiment is configured to form images of four colors, i.e., yellow, magenta, cyan and black images, the toner colors should not be limited to these. For example, it is possible to use a configuration that forms images of six colors, including lightcyan (LC) and lightmagenta (LM) having the same hues as, but lower densities than, cyan and magenta, in addition to the above four colors.

The reference numerals of components of the image forming station in FIG. 1 are allotted in a representative manner to the image forming station 50Y for yellow images alone while reference numerals for the components of the other image forming stations 50M, 50C and 50B are omitted.

Image forming stations 50Y, 50M, 50C and 50B each include photoreceptor 51 as an electrostatic latent image bearer forming an electrostatic latent image. Arranged around each photoreceptor 51 are a charging unit 52, an exposure unit 53, a developing device 1, a transfer roller 55 and a cleaning unit 56, in a circumferential direction.

Photoreceptor 51 is an approximately drum-shaped cylinder having photosensitive materials such as OPC (Organic Photoconductor) etc., formed thereon, and is arranged under exposure unit 53 and controlled by an unillustrated driver and controller so as to rotate in a predetermined direction (in the direction indicated by arrow F in the drawing).

Charging unit 52 is a charger for uniformly electrifying the photoreceptor 51 surface at a predetermined potential, and is arranged above, and close to the outer peripheral surface of, photoreceptor 51. In the present embodiment, a contact type roller-shaped charging roller is used, but charging devices of a discharge type, brush type, ion emission type, etc. may be used.

Exposure unit 53 has a function of writing an electrostatic latent image in accordance with image data on the photoreceptor 51 surface by emitting laser light onto the surface of photoreceptor 51 electrified by charging unit 52, in accordance with image data output from an image processor (not shown).

In each of image forming stations 50Y, 50M, 50C and 50B, exposure unit 53 is supplied with image data corresponding to the related color, i.e., yellow, magenta, cyan or black, to form an electrostatic latent image of the corresponding color. As exposure unit 53, a laser scanning unit (LSU) including a laser emitter and reflections mirrors, or a writing unit (e.g., writing head) having an array of light emitting elements such as ELs, LEDs or the like, can be used.

Developing device 1 includes developing roller 3 (FIG. 2) as a developer bearer for supporting a developer.

Developing roller 3 conveys the developer to the development area where developing roller 3 and photoreceptor 51 get close to each other so that the toner on the developing roller 3 surface transfers to photoreceptor 51.

This developing device 1 in this embodiment is a so-called mono-component developing device that uses toner as a developer, and forms a toner image (visual image) by developing the electrostatic latent image formed on the photoreceptor 51 surface by exposure unit 53, with the toner.

Developing device 1 of image forming station 50Y, 50M, 50C or 50B stores a yellow, magenta, cyan or black developer, in association with the corresponding color. These developers include toner charged with the same polarity as that of the surface potential of the electrified photoreceptor 51.

Transfer roller 55 transfers the toner image formed on photoreceptor 51 to the surface of paper P conveyed by a conveyor belt 33, and has a transfer roller to which a bias voltage of the opposite polarity to that of the charge on the toner (the positive (plus) polarity in the present embodiment) is applied.

Cleaning unit 56 removes and collects the toner residing on the outer peripheral surface of photoreceptor 51 after transfer of a toner image to paper P. In the present embodiment, the cleaning unit 56 is arranged at a position on the approximately opposite side across photoreceptor 51 from developing device 1, and close to photoreceptor drum 51.

Conveyor system 30 includes a drive roller 31, a driven roller 32 and conveyor belt 33, and conveys paper P to which the toner images of the colors are transferred through image forming stations 50Y, 50M, 50C are 50B. Conveyor system 30 is configured such that endless conveyor belt 33 is stretched and wound between drive roller 31 and driven roller 32, and conveys paper P fed from paper feed tray 60 through image forming stations 50Y, 50M, 50C and 50B, successively.

Fixing device 40 includes a heat roller 41 and a pressing roller 42, and conveys paper P through the fixing nip portion formed by these rollers to thereby heat and press the toner image transferred on paper P and fix the toner image to the paper P.

In image forming apparatus 100 thus configured, paper P is conveyed by conveyor system 30 through the opposing positions of photoreceptors 51 of image forming stations 50Y, 50M, 50C and 50B, during which the toner image on each photoreceptor 51 is successively transferred to paper P by the function of the transfer electric field from transfer roller 55 arranged at and under the opposing position via conveyor belt 33. With this arrangement, the toner images of different colors are transferred one over the other on paper P so that a desired full-color toner image is formed on the paper P. The paper P with the toner image thus transferred thereon passes through fixing unit 40 where the toner image is fixed, and then is sent out to a paper output tray.

Next, the configuration of developing device 1 will be described with reference to the drawings.

Figure 2:
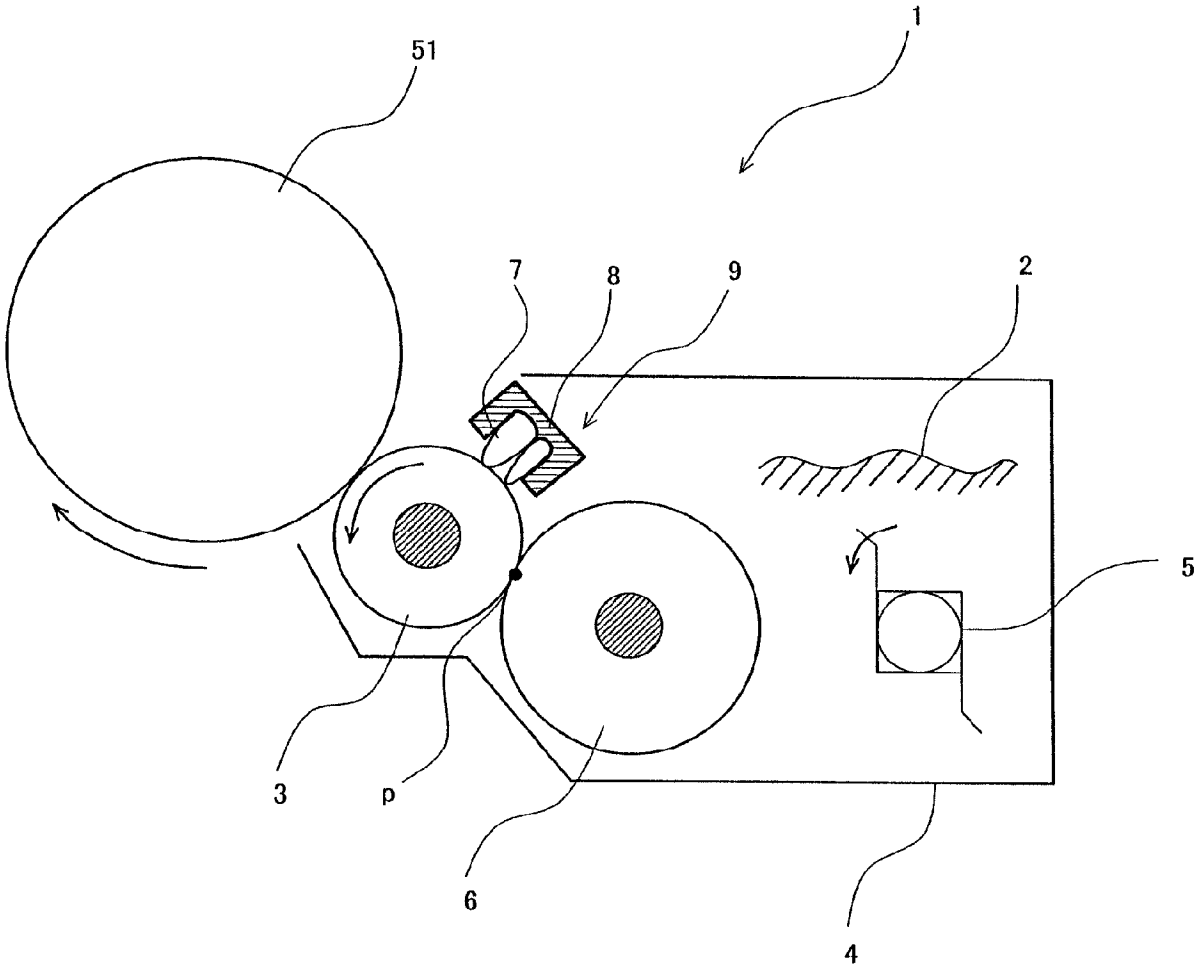
FIG. 2 is an illustrative view showing a schematic configuration of a developing device according to the present embodiment.

FIG. 2 is an illustrative view showing a schematic configuration of a developing device according to the present embodiment.

Developing device 1 of the present embodiment essentially includes: as shown in FIG. 2, a developing roller 3 supporting toner 2; a developing hopper 4 for storing toner 2; an agitation conveyor 5 agitating and conveying toner 2 inside developing hopper 4, a supply roller 6 and a toner layer regulatory member 9.

Toner layer regulatory member 9 is formed of flexible sheets (elastic parts) 7 and a sheet holder (holding part) 8 holding flexible sheets 7.

Agitation conveyor 5 is rotatably arranged inside developing hopper 4 and rotates in the counterclockwise direction as indicated by an arrow. In developing hopper 4, agitation conveyor 5 is formed of an unillustrated rotational shaft and unillustrated multiple blades projected radially outwards from the rotational shaft. The blades are formed in a plate-like shape of a resin such as PET (Polyethylene Terephthalate) or the like.

Supply roller 6 is a roller that is formed of a porous elastic material such as foamed urethane or the like and takes up toner 2 in pores on the surface thereof and rubs developing roller 3 to supply toner 2 to developing roller 3 and clean the surplus toner left on developing roller 3 after development.

The amount of bite at the contact part p between supply roller 6 and developing roller 3 is set at 0.5 mm and the length of this contact part p, i.e., the dimension along the direction in which the axis of supply roller 6 extends (which may also be referred to hereinbelow as "axial direction") is specified at 330 mm.

Here, in the present embodiment, supply roller 6 is formed of urethane sponge having an Ascar C hardness of 5 degrees and specified to be 16 mm in diameter. The Ascar C hardness is specified by the Society of Rubber Industry, Japan Standard.

Developing hopper 4 is a receptacle that is made of, for example, hard synthetic resin or the like, and has an approximately rectangular parallelepiped configuration in appearance. Toner 2 is essentially formed of polyester resin, and produced by pulverization so as to have a volume mean particle diameter of 9 μm.

Developing roller 3 is arranged in a rotatable manner inside developing hopper 4 and supports the toner 2 stored in developing hopper 4 and conveys the toner to photoreceptor 51. Developing roller 3 is arranged opposing photoreceptor 51 so that its axis is parallel to the rotational axis of photoreceptor 51, and is supported by an unillustrated frame of the developing hopper 4 body. The rotational direction of developing roller 3 is opposite to that of photoreceptor 51.

In the present embodiment, developing roller 3 is formed of an aluminum cylinder having a diameter of 16 mm with a wall thickness of 1 mm and is sandblasted so as to have an arithmetic means surface roughness Ra of 0.3 to 0.8 μm. Developing roller 3 is rotated on the axis at a circumferential speed of 145 mm/sec.

The circumferential speed of photoreceptor 51 is set at 145 mm/sec., the circumferential speed of supply roller 6 is set at 116 mm/sec., and the rotational rate of agitation conveyor 5 is set at 157 rpm. Photoreceptor 51 is 30 mm in diameter and arranged so as to be spaced from the developer 3 surface with a gap of 200±20 μm by means of unillustrated spacers.

Arranged above developing roller 3 is a toner layer regulatory member 9 having flexible sheets 7 and a sheet holder 8 to form a toner 2 layer of a constant thickness.

Flexible sheet 7 is a thin film formed of urethane rubber, and is curved with its two ends held by a depression of sheet holder 8, forming a U-shape. The curved tip in the U-shape is used to limit the layer of toner 2 on developing roller 3.

In this arrangement, a layer of uniformly charged toner 2 can be supported on developing roller 3. This layer of toner 2 having static electricity is supplied from developing roller 3 to photoreceptor 51 in accordance with the potential difference between developing roller 3 and photoreceptor 5 to develop the electrostatic latent image and form a toner image.

The hardness of flexible sheet 7 is preferably set to have a JIS-A hardness of 65° to 85°. In the present embodiment, the flexible sheet is specified to be 70° to 80° in hardness and 0.3 to 1.0 mm thick.

Sheet holder 8 is formed of, for example, a hard synthetic resin or the like formed with depressions having a width of 1.5 to 3 mm.

Now, the configuration of toner layer regulatory member 9 will be described in detail with reference to the drawings.

FIG. 3 is an illustrative view showing a configuration of a toner layer regulatory member of the present embodiment. FIG. 4A detailedly shows a part designated at A in FIG. 3 and is a detailed illustrative view showing a held condition of a flexible sheet around a depression of a sheet holder as a part of the toner layer regulatory member. FIG. 4B is an illustrative view showing a force (force components) applied on a slope (curved surface) of a depression of the sheet holder. FIG. 4C is an illustrative view showing a force (components of force) applied on a side surface of a depression of the sheet holder.

Toner layer regulatory member 9 includes, as shown in FIG. 3, a first flexible sheet 7*a* and a second flexible sheet 7*b* as flexible sheets 7 and a sheet holder 8.

Sheet holder 8 has a first depression 8*a* for first flexible sheet 7*a* and a second depression 8*b* for second flexible sheet 7*b*.

Sheet holder 8 has curved surfaces 8*a*1 and 8*b*1 formed in first and second depressions 8*a* and 8*b*, respectively, which make it possible to hold first flexible sheet 7*a* and second flexible sheet 7*b* in a movable manner.

First and second depressions 8*a* and 8*b* are formed in parallel with each other with respect to the axial direction of developing roller 3. That is, the direction in which first and second depressions extend is the same as the axial direction of developing roller 3.

The directions of curvature of curved surfaces 8*a*1 and 8*b*1 are the same as the direction of curvature of the vertical section of developing roller 3, a plane perpendicular to the rotational axis of developing roller 3. That is, the aforementioned curved surfaces 8*a*1 and 8*b*1 are formed so that, in their vertical sections, the peak of each curved surface is located more distant from developing roller 3 than both ends of the curved surface.

First and second flexible sheet 7*a* and 7*b* are each formed of a rectangular sheet, curved in a U-shape and arranged with their longitudinal sides aligned in the axial direction of developing roller 3, and held in first and second depressions 8*a* and 8*b*, respectively.

First and second flexible sheets 7*a* and 7*b* respectively held in a U-shaped form in first and second depressions 8*a* and 8*b* are arranged so that the U-shaped projected tips P1 and P2 (free ends) are directed toward developing roller 3. That is, the external surfaces (curved surfaces) of U-shaped projected ends (curved portions) P1 and P2 of first and second flexible sheets 7*a* and 7*b* can be put in contact along the axial direction of developing roller 3 with developing roller 3.

Here, the shapes of first and second flexible sheets 7*a* and 7*b* should not be limited to rectangles but any shape may be accepted as long as the operation and effect as follows can be achieved.

Further, for example as shown in FIG. 3, narrowing the width W1 of first depression 8*a* located on the upstream side with respect to the circumferential direction of developing roller 3 while thickening first flexible sheet 7*a* held in a U-shape, makes it possible to narrow the abutment width and increase the pressure of abutment, whereby it is possible to achieve toner layer regulation with a reduced stress on the toner.

Moreover, widening the width W2 of second depression 8*b* on the downstream side with respect to the circumferential direction of developing roller 3 while thinning second flexible sheet 7*b* held thereby, makes it possible to widen the abutment width and reduce the pressure of abutment, whereby it is possible to electrify the toner with a reduced stress on the toner.

Now, the force acting on flexible sheet 7 will be described by taking an example of second flexible sheet 7*b* with reference to the drawings.

As shown in FIG. 3, when the second flexible sheet 7*b* held in a U-shape is pushed toward developing roller 3 (at the time of abutment), both end parts 7*b*1 (supported ends) supported by sheet holder 8 receives a force F-1 from the developing roller 3 side, as shown in FIG. 4A.

As shown in FIGS. 4A and 4B, force F-1 can be decomposed into a component force F-1*a* in the direction approximately perpendicular to curved surface 8*b*1 of second depression 8*b* of sheet holder 8 and a component force F-1*b* in the direction approximately parallel to curved surface 8*b*1 (FIG. 4B).

When the push-in quantity (pressing strength) of second flexible sheet 7*b* acting on developing roller 3 increases so that force F-1*b* exceeds a predetermined level, or when the pressure of abutment between second flexible sheet 7*b* and developing roller 3 exceeds a predetermined value, end 7*b*1 of second flexible sheet 7*b* moves in the direction of arrow B (upwards and leftwards in FIG. 4A) and the U-shaped projected tip P2 proportionally moves relative to sheet holder 8. Accordingly, if the push-in quantity of sheet holder 8 to developing roller 3 increases, the amount of abutment between the U-shaped projected tip P2 of second flexible sheet 7*b* and developing roller 3 will not vary, whereby the predetermined pressure of abutment between the U-shaped projected tip P2 and developing roller 3 can be maintained.

As another case, when, with both edges (both ends) 7*b*1 of second flexible sheet 7*b* located on curved surface 8*b*1, the push-in quantity of sheet holder 8 to developing roller 3 becomes smaller due to radial run-out of developing roller 3, the component force F-2*b* of the repulsive force F-2 of second flexible sheet 7*b*, directed approximately parallel to curved surface 8*b*1, moves both ends 7*b*1 of second flexible sheet 7*b* as shown in FIGS. 4A and 4C, hence U-shaped projected tip P2 also moves relative to sheet holder 8. As a result, if the push-in quantity of sheet holder 8 to developing roller 3 decreases, the predetermined pressure of abutment between the U-shaped projected tip P2 and developing roller 3 can be maintained. First flexible sheet 7*a* also makes the same operation as second flexible sheet 7*b*.

Next, the pressure of abutment of flexible sheet 7 of the present embodiment on developing roller 3 and that of the conventional blade (toner layer regulatory member) depending on the push-in quantity will be compared.

FIG. 5 is a graph showing the relationship between the push-in quantity and the pressure of abutment to compare the flexible sheet of the present embodiment with the conventional blade.

As shown in FIG. 5, in the case of a conventional blade, the pressure of abutment varies proportionally to the push-in quantity. Variation of the pressure of abutment depending on the push-in quantity is large when the spring constant is large (shown with a broken line), whereas variation of the pressure of abutment depending on the push-in quantity is small when the spring constant is small (shown with a fine broken line). On the other hand, use of flexible sheet 7 of the present embodiment makes it possible to apply an approximately constant pressure of abutment regardless of the push-in quantity (shown with a fine line). The effect of the configuration of the present embodiment becomes obvious especially around the center of the graph.

Here, the stable pressure of abutment, and width of abutment (the length in the circumferential direction of developing roller 3), between flexible sheet 7 and developing roller 3 can be controlled by the shape of the depressions in sheet holder 8 and the thickness of flexible sheet 7.

Further, when depressions 8*a* and 8*b* of sheet holder 8 are configured so as to increase the force F-1*b*, the component force of force F-1 that is approximately parallel to curved surface of 8*b*1 (so that the curvature of curved surface 8*b*1 becomes greater or the radius of curvature of curved surface 8*b*1 becomes smaller), it is possible to lower force F-1 for moving both ends 7*b*1 of second flexible sheet 7*b*, or the pressure of abutment between U-shaped projected tip P2 and developing roller 3.

As described heretofore, according to the present embodiment, toner layer regulatory member 9 of developing device 1 includes flexible sheets 7 abutting developing roller 3 and sheet holder 8 for holding flexible sheets 7. Flexible sheets 7 includes first flexible sheet 7*a* curved in a U-shape and second flexible sheet 7*b* curved in a U-shape. First flexible sheet 7*a* and second flexible sheet 7*b* are formed extending in the axial direction of developing roller 3 and arranged parallel to each other, or side by side across the circumferential direction of developing roller 3. First flexible sheet 7*a* and second flexible sheet 7*b* arranged so that their U-shaped projected ends that extend in the axial direction of developing roller 3 oppose developing roller 3 while their two ends extending in the axial direction of developing roller 3 are held as supported ends by sheet holder 8. Sheet holder 8 is formed with first depression 8*a* and second depression 8*b* that hold first flexible sheet 7*a* and second flexible sheet 7*b* so as to enable their U-shaped projected tips to move relative to sheet holder 8.

With the above configuration, if the push-in quantity of flexible sheets 7 to developing roller 3 increases (if the distance between sheet holder 8 and developing roller 3 decreases), the pressure of abutment between U-shaped projected tips P1 and P2 and developing roller 3 will not change and can be kept at the predetermined pressure, so that it is possible to suppress deformation of the abutment between flexible sheets 7 and developing roller 3 while assuring a stable pressure of abutment.

Further, according to the present embodiment, since multiple flexible sheets 7 (first flexible sheet 7*a* and second flexible sheet 7*b*) are provided, by specifying the thickness (width) and hardness of flexible sheets 7 in different ways, it is possible to perform toner layer regulation with enhanced pressure of abutment and a reduced width of abutment of flexible sheet 7 and achieve electrification with a low pressure of abutment and a large width of abutment, hence it is possible to alleviate stress on the toner.

VARIATIONAL EXAMPLE 1

Next, a variational example 1 of toner layer regulatory member 9 of the present embodiment will be described with reference to the drawing.

FIG. 6 is an illustrative view showing variational example 1 of a toner layer regulatory member of the present embodiment.

As shown in FIG. 6, a toner layer regulatory member 109 of variational example 1 includes a first flexible sheet 107*a* and a second flexible sheet 107*b* as flexible sheets 107 and a sheet holder 108 having a first depression 108*a* for first flexible sheet 107*a* and a second depression 108*b* for second flexible sheet 107*b*.

Instead of curved surfaces 8*a*1 and 8*b*1 shown in FIG. 3, sheet holder 108 has first and second depressions 108*a* and 108*b*, each having a triangled vertical section, forming slopes 108*a*1 and 108*a*2 and slopes 108*b*1 and 108*b*2, respectively.

With this configuration according to variational example 1, similarly to sheet holder 8 of toner layer regulatory member 9 of the above-described embodiment, if the push-in quantity between sheet holder 108 and developing roller 3 changes, it is possible to hold the two ends of the two sheets in a movable manner along the slope of 108*a*1 and 108*a*2 of first depression 108*a* and along the slope of 108*b*1 and 108*b*2 of second depression 108*b*, respectively, so that the actual push-in quantity of the U-shaped projected tips of first and second flexible sheets 107*a* and 107*b* to developing roller 3 will not vary, whereby the predetermined pressure of abutment between the U-shaped projected tips and developing roller 3 can be maintained.

That is, since first depression 108*a* and second depression 108*b* of sheet holder 108 are formed with slopes, the force component parallel to each slope of the force received when the push-in quantity of first and second flexible sheets 107*a* and 107*b* to developing roller 3 increases will not change along the slopes so that it is possible to easily keep a stable pressure of abutment by just changing the inclined angle of the slope.

VARIATIONAL EXAMPLE 2

Next, a variational example 2 of toner layer regulatory member 9 of the present embodiment will be described with reference to the drawing.

FIG. 7 is an illustrative view showing variational example 2 of a toner layer regulatory member of the present embodiment.

As shown in FIG. 7, a toner layer regulatory member 209 of variational example 2 includes a first flexible sheet 207*a* and a second flexible sheet 207*b* as flexible sheets 207 and a sheet holder 208 having a first depression 208*a* for first flexible sheet 207*a* and a second depression 208*b* for second flexible sheet 207*b*.

Sheet holder 208 has first depressions 208*a* and second depressions 208*b*, having curved surfaces 208*a*1 and 208*b*1, respectively, which incline towards one side only, with respect to the rotational direction of developing roller 3 so that only the one-side ends 207*a*1 and 207*a*2 of first and second flexible sheets 207*a* and 207*b* can move as the push-in quantity varies. That is, curved surfaces 208*a*1 and 208*b*1 are so formed that one end of each curved surface is the most distant, and the other end is the closest, from developing roller 3, with respect to the rotational direction of developing roller 3.

Since curved surfaces 208*a*1 and 208*b*1 are thus configured, according to variational example 2, similarly to sheet holder 8 of toner layer regulatory member 9 of the above-described embodiment, if the push-in quantity of first flexible sheet 207*a* and second flexible sheet 207*b* to developing roller 3 changes, sheet ends 207*a*1 and 207*b*1 located on the side shortest from developing roller 3 can be held in a movable manner. Accordingly, the actual push-in quantity of the U-shaped projected tips of first and second flexible sheets 207*a* and 207*b* to developing roller 3 will not vary, whereby the predetermined pressure of abutment between the U-shaped projected tips and developing roller 3 can be maintained.

Further, according to variational example 2, since only one-side ends 207*a*1 and 207*b*1 of first and second flexible sheets 207*a* and 207*b* can move for curved surfaces 208*a*1 and 208*b*1, greater force is applied to movable ends 207*a*1 and 207*b*1 of flexible sheets 7 compared to the configuration in which both ends can move, so that the flexible sheets are moved by a small change in pressure of abutment, thus making it possible to stabilize the pressure of abutment between the U-shaped projected tips and developing roller 3.

Moreover, according to variational example 2, since the other side ends 207*a*2 and 207*b*2 (on the side of each of curved surfaces 208*a*1 and 208*b*1 from which the distance to developing roller 3 is longest) of first and second flexible sheets 207*a* and 207*b* are fixed, it is possible to hold first and second flexible sheets 207*a* and 207*b* stably by means of sheet holder 208.

VARIATIONAL EXAMPLE 3

Next, a variational example 3 of toner layer regulatory member 9 of the present embodiment will be described with reference to the drawing.

FIG. 8 is an illustrative view showing variational example 3 of a toner layer regulatory member of the present embodiment.

As shown in FIG. 8, a toner layer regulatory member 309 of variational example 3 includes a first flexible sheet 307*a* and a second flexible sheet 307*b* as flexible sheets 307. Instead of first depressions 208*a* and second depressions 208*b* of variational example 2, having curved surfaces 208*a*1 and 208*b*1, respectively, which incline towards one side, first depression 308*a* and second depression 308*b* of sheet holder 308 have slopes 308*a*1 and 308*b*1 inclined to one side.

This configuration according to variational example 3 makes it possible to achieve the same effect as that of toner layer regulatory member 209 of variational example 2.

VARIATIONAL EXAMPLE 4

Next, a variational example 4 of toner layer regulatory member 9 of the present embodiment will be described with reference to the drawing.

FIG. 9 is an illustrative view showing variational example 4 of a toner layer regulatory member of the present embodiment.

As shown in FIG. 9, a toner layer regulatory member 409 of variational example 4 includes a first flexible sheet 407*a* and a second flexible sheet 407*b* as flexible sheets 407 and a sheet holder 408 having a first depression 408*a* for first flexible sheet 407*a* and a second depression 408*b* for second flexible sheet 407*b*.

First depression 408*a* has a slope 408*a*1 inclined to one side similar to first depression 308*a* of variational example 3. Second depression 408*b* has a curved surface 408*b*1 curved upward similar to second depression 208*b* of variational example 2 of the above-described embodiment.

With this configuration according to variational example 4, similarly to first depression 308*a* of variational example 3 and second depression 208*b* of variational example 2 of the above-described embodiment, if the push-in quantity of first flexible sheet 407*a* and second flexible sheet 407*b* changes, it is possible to hold the ends of the two sheets in a movable manner along the slope of 408*a*1 of first depression 408*a* and along curved surface 408*b*1 of second depression 408*b*, so that the actual push-in quantity between the U-shaped projected tips of the flexible sheets and developing roller 3 will not vary, whereby the predetermined pressure of abutment between the U-shaped projected tips and developing roller 3 can be maintained.

As another variational example, the depressions of the sheet holder may be formed by combination of the depressions of the sheet holders in the embodiment and variational examples described above, or by combination of a depression having a curved surface and a depression having a slope or slopes while the flexible sheets may be fixed at one side end or at both side ends in a movable manner.

As have been described, the present invention should not be limited to the above embodiment and variational examples and various changes can be made within the range specified in the scope of claims. That is, any embodied mode obtained by combination of technical means modified as appropriate without departing from the spirit and scope of the present invention should be included in the technical art of the present invention.

What is claimed is:

1. A developing device for use in an image forming apparatus for visualizing an electrostatic latent image on an electrostatic latent image bearer with toner, comprising:

a developing roller configured to supply toner to an electrostatic latent image bearer in an image forming apparatus; and, a toner layer regulatory member configured to be brought in pressing contact with the developing roller to regulate the layer thickness of toner supported on a surface of the developing roller, characterized in that wherein the toner layer regulatory member contains a plurality of flexible elastic sheet parts abutting the developing roller and a holding part holding each of the plurality of flexible elastic sheet parts, each of the plurality of flexible elastic sheet parts is formed along an axial direction of the developing roller and arranged side by side across a circumferential direction of the developing roller, each of the plurality of flexible elastic sheet parts forms a free end and supported ends, the free end is a projected end which extends in the axial direction of the developing roller and projects toward the developing roller, the supported ends are the other end side of the free end and are held by the holding part, and the holding part has a depression which holds the other end side of each of the plurality of flexible elastic sheet parts in such a manner that the free end side of the elastic part can move, the holding part contains a plurality of depressions corresponding to the plural elastic parts, each of the plurality of the depressions has a curved surface or a slope as a holdable portion for enabling to hold at least one of the supported ends of the elastic part, the curved surface or the slope is formed in such a manner that as a distance between the developing roller and a position on the curved surface or the slope becomes longer, a width of a depression space formed by the curved surface or the slope with respect to the circumferential direction of the developing roller becomes narrower, and the supported ends are movable at both ends or at one end along the curved surface or the slope.

2. The developing device according to claim 1, wherein the elastic part is held in the depression in a curved condition.

3. The developing device according to claim 1, wherein the plural elastic parts are specified such that a thickness of each of the plurality of flexible elastic sheet parts located on an upstream side with respect to a rotational direction of the developing roller is greater than a thickness of the elastic part located on a downstream side with respect to the rotational direction of the developing roller, and the width in the circumferential direction of the developing roller of each of the plurality of the depressions is made narrower in the depression located on the upstream side with respect to the rotational direction of the developing roller than in the depression on the downstream side with respect to the rotational direction of the developing roller.

4. An image forming apparatus for performing image forming based on electrophotography, comprising:

an electrostatic latent image bearer on which an electrostatic latent image is formed; and a developing device configured to visualize the electrostatic latent image on the electrostatic latent image bearer with toner, wherein the developing device employs the developing device according to claim 1.

* * * * *